United States Patent [19]

Obernberger

[11] 4,320,798

[45] Mar. 23, 1982

[54] COOLING SYSTEM FOR LIQUID-COOLED INTERNAL COMBUSTION ENGINES

[75] Inventor: Klaus Obernberger, Odelzhausen, Fed. Rep. of Germany

[73] Assignee: Bayerische Motoren Werke Aktiengesellschaft, Munich, Fed. Rep. of Germany

[21] Appl. No.: 95,952

[22] Filed: Nov. 20, 1979

[30] Foreign Application Priority Data

Apr. 25, 1979 [DE] Fed. Rep. of Germany ..... 2916691

[51] Int. Cl.[3] ..... G05D 23/00

[52] U.S. Cl. ..... 165/36; 165/51; 165/74; 236/34.5; 123/41.09

[58] Field of Search ..... 440/88; 165/32, 35, 165/36, 38, 51, 72, 103, 74; 236/34.5; 123/41.09, 41.17, 41.42, 41.55

[56] References Cited

U.S. PATENT DOCUMENTS

| | | | |
|---|---|---|---|
| 2,322,047 | 6/1943 | Mormile | 165/36 |
| 2,474,162 | 6/1949 | Ramsaur | 236/34.5 |
| 2,513,124 | 6/1950 | Weiks | 165/35 |
| 3,510,060 | 5/1970 | Starmühler | 236/34.5 |
| 4,147,139 | 4/1979 | Hass | 236/34.5 |
| 4,156,408 | 5/1979 | Protze | 165/35 |
| 4,209,062 | 6/1980 | Woodhull | 165/38 |
| 4,260,011 | 4/1981 | Brown | 165/35 |

FOREIGN PATENT DOCUMENTS

| | | | |
|---|---|---|---|
| 52-76539 | 6/1977 | Japan | 123/41.09 |

*Primary Examiner*—Albert W. Davis
*Assistant Examiner*—Margaret A. Focarino
*Attorney, Agent, or Firm*—Craig and Antonelli

[57] ABSTRACT

A cooling installation for liquid-cooled internal combustion engines, especially for water crafts having a combined fresh-water/sea-water cooling system of the internal combustion engine, with a housing that includes a liquid heat-exchanger for the engine cooling medium and an external cooling medium, a by-pass channel for the engine cooling medium in parallel to the heat-exchanger, a mixing chamber for the cooled and non-cooled portion of the engine cooling medium and a thermostat for the temperature-dependent proportional through-flow control of the engine cooling medium through the heat-exchanger and through the by-pass channel; the mixing chamber is arranged at a distance from the outlet side of the heat-exchanger while the thermostat is arranged in the mixing chamber and alternately controls a respective inlet opening leading into the mixing chamber; a closure cover which is removably secured externally at the housing is arranged opposite an inlet opening of the mixing chamber and closes off an installation opening for the thermostat assembly.

9 Claims, 3 Drawing Figures

COOLING SYSTEM FOR LIQUID-COOLED INTERNAL COMBUSTION ENGINES

The present invention relates to a cooling system for liquid-cooled internal combustion engines, especially for water-crafts with a combined fresh-water/sea-water cooling system of the internal combustion engine.

In a known cooling installation of this type of construction (Hermann Mettig, "Die Konstruktion schnellaufender Verbrennungsmotoren"["The Construction of Rapidly Rotating Combustion Engines"], page 235) two thermostats are connected inside of the housing ahead of the heat-exchanger inlet which alternately conduct the inflow of the engine cooling medium to the heat-exchanger or to one each of the by-pass channels formed-on internally and externally at the housing. A very expensive housing construction and also an unfavorable accessibility to the thermostat inserts result therefrom. Thus, the prior art housing includes on its inside additional installation openings for the thermostat assemblies and for the by-pass channel connections. A large-surface removable flange cover for securing the access to the thermostat inserts is provided at the top side of the housing. Finally, the heat-exchanger is secured in the housing by means of flange covers on both sides which are provided with flange connections for the inlet and outlet of the external cooling medium. Altogether the structural expenditure and the weight of this cooling installation is disadvantageously high. Also, the installed position of the thermostats at the branching place on the inlet side to the heat-exchanger inlet and to the by-pass channel is functionally unfavorable because the temperature control of the engine cooling medium is thus not possible without considerable temperature fluctuations.

It is the aim of the present invention to so further develop a cooling installation of the aforementioned type that it involves lesser constructional expenditures, a smaller weight and also a more uniform temperature control function.

The underlying problems are solved according to the present invention in that the mixing chamber is arranged at a distance from the outlet side of the heat-exchanger, the thermostat is arranged in the mixing chamber and alternately controls respective inlet channels leading into the mixing chamber and connected, on the one hand, with the heat-exchanger and, on the other, with the by-pass channel, and in that a closure cover removably secured externally at the housing is arranged opposite an inlet opening of the mixing chamber and closes an installation opening for a thermostat insert. In this manner a more simple overall construction of the cooling installation, smaller structural dimensions thereof, a better functioning of the thermostat which is thereby arranged at the mixing place of the cooled and uncooled portions of the engine cooling medium, and a favorable accessibility for the installation and the eventual replacement of the thermostat assembly results therefrom.

Accordingly, it is an object of the present invention to provide a cooling installation for liquid-cooled internal combustion engines, especially for water-crafts with a combined fresh-water/sea-water cooling system of the internal combustion engine which avoids by simple means the aforementioned shortcomings and drawbacks encountered in the prior art.

Another object of the present invention resides in a cooling installation for liquid-cooled internal combustion engines, especially for water-crafts having a combined fresh-water/sea-water cooling system of the internal combustion engine which permits a reduction in the structural expenditures, a lower weight and also a more uniform temperature control.

A further object of the present invention resides in a cooling installation for liquid-cooled internal combustion engines of the type described above which assures an effective cooling system involving smaller structural dimensions, improved operation of the thermostatic control and more favorable accessibility thereof for purposes of installation and eventual replacement of the thermostat.

A still further object of the present invention resides in a cooling installation for liquid-cooled internal combustion engines, especially for water-crafts having a combined fresh-water/sea-water cooling system of the internal combustion engine which not only requires less space and reduces overall costs but additionally is more favorable as regards service, especially of the thermostat thereof.

These and other objects, features and advantages of the present invention will become more apparent from the following description when taken in connection with the accompanying drawing which shows, for purposes of illustration only, one embodiment in accordance with the present invention, and wherein.

Figure 1:
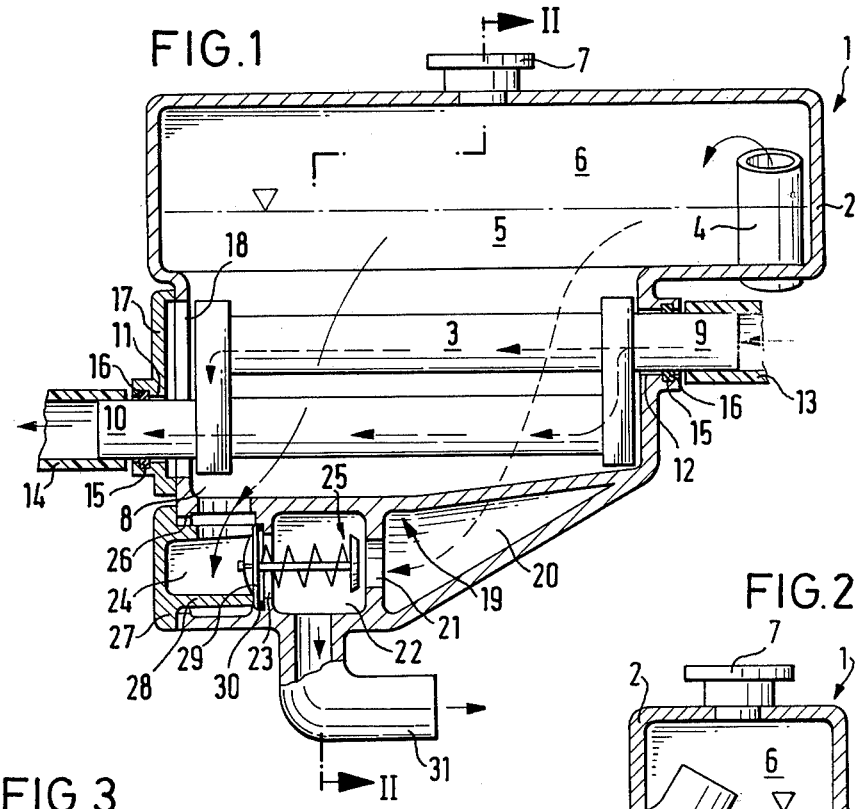
FIG. 1 is a somewhat schematic, longitudinal cross-sectional view of a cooling installation for water-crafts with a combined fresh-water/sea-water cooling system of a liquid-cooled internal combustion engine in accordance with the present invention.
Figure 2:
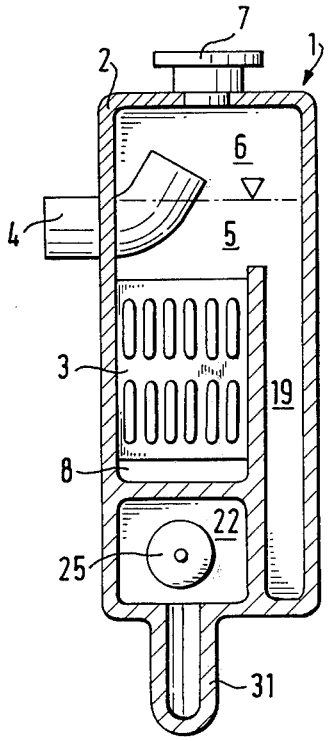
FIG. 2 is a transverse cross-sectional view taken along line II—II of FIG. 1.
Figure 3:
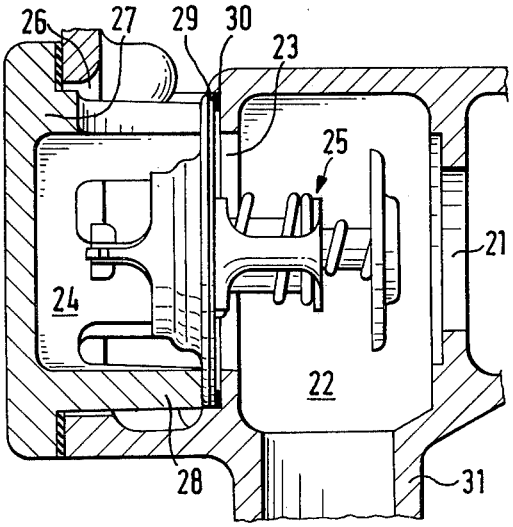
FIG. 3 is a partial cross-sectional view, on an enlarged scale, illustrating the area of a thermostat assembly in the system of FIG. 1.

Referring now to the drawing wherein like reference numerals are used throughout the various views to designate like parts, a cooling installation generally designated by reference numeral 1 for an internal combustion engine (not shown) for installation in water-crafts with a combined fresh-water/sea-water cooling system contains within a housing 2 a liquid heat-exchanger 3 for an engine cooling medium which, as customary, consists of fresh water and antifreeze and/or corrosion protection additives, and for an external cooling medium which is formed by natural water such as pipe or tap water, river water, lake water or ocean water. The engine cooling medium flows through the heat-exchanger 3 from an inlet pipe connection 4 by way of an upper water box 5 with an expansion space 6 and a filling closure 7 from the top toward the bottom. A lower water box 8 is located below the heat-exchanger 3.

For the external cooling medium, the heat-exchanger 3 includes one inlet pipe connection 9 and one outlet pipe connection 10 each. These pipe connections 9 and 10 serve at the same time both as mounting means for the heat-exchanger 3 in the housing apertures 11 and 12 and also as hose connections for the external cooling medium hoses 13 and 14. The apertures 11 and 12 include in one annular groove 15 each one O-ring 16 each as seal. Whereas the aperture 12 is arranged directly in the housing 1, the aperture 11 is formed in a housing cover 17 which enables the installation and possibly the exchange of the heat-exchanger 3 through a lateral opening 18 of the housing 2.

The housing 2 includes a by-pass channel 19 in parallel with the heat-exchanger 3 which extends in a shaft-shaped narrow manner over the length of the heat-exchanger 3 and terminates below the water box 8 in an inlet chamber 20 which is in communication with a mixing chamber 22 by way of an inlet opening 21. A further inlet opening 23 of the mixing chamber 22 is connected with the lower water box 8 by way of a second inlet chamber 24. The inlet openings 21 and 23 of the mixing chamber 22 are alternately controlled in dependence on temperature by the valves of a thermostat insert or thermostat assembly generally designated by reference numeral 25. With a cold engine-cooling medium, the inlet opening 23 is closed corresponding to the illustrated arrangement.

The second inlet chamber 24 includes within the housing 2 an installation opening 26 opposite the inlet opening 23, which is sealed off by a closure cover 27. The closure cover 27 carries on its inside coaxial ring-shaped support extensions 28 arranged at a distance from one another which press a flange 29 of the thermostat insert 25 against the housing wall surrounding the inlet opening 23 under interposition of a seal 30. The flow connection with the lower water box 8 is assured between the support extensions 28 while the inlet chamber 24 is arranged inside of these support extensions 28.

An outlet pipe connection 31 for the further conduction of the engine cooling medium which is controlled to the predetermined operating temperature, to the places of the engine to be cooled, respectively, to the suction side of the cooling medium pump are formed-on at the mixing chamber 22.

For the operation of the engine, the cooling installation 1 is filled up to a predetermined cooling medium level through the closure cover 7. The remaining air space serves as expansion space for the cooling medium which expands during the warm-up. With a running internal combustion engine, engine cooling medium is continuously supplied into the upper water box 5 by a cooling medium pump (not shown) through the inlet pipe connection 4. Up to the point of reaching the predetermined operating temperature, the thermostat assembly 25 closes the inlet opening 23 and therewith the passage of engine cooling medium through the heat-exchanger 3, the lower water box 8, the second inlet chamber 24, and the inlet opening 23 into the mixing chamber 22. In contrast thereto, the engine cooling medium can reach unimpairedly the first inlet chamber 20 through the by-pass channel 19 and the mixing chamber 22 through the inlet opening 21 and may flow through the outlet pipe connection 31 to the cooling medium pump and to the internal combustion engine. Simultaneously therewith, the external cooling medium is fed through the cooling medium hoses 13 and 14 and through the hose pipe connections 9 and 10 of the heat-exchanger 3 through the latter by means of a separate external cooling medium pump (not shown). A heat-exchange between the external cooling medium and the engine cooling medium thereby does not take place by reason of lack of through-flow of the heat-exchanger 3 with engine cooling medium. As a result thereof, the engine can heat up very rapidly. The engine cooling medium flowing through the by-pass channel 19 thus also heats up and acts upon the thermostat assembly 25 which upon reaching the predetermined control temperature responds and commences to open the inlet opening 23. As a result thereof, engine cooling medium which is cooled off by the heat-exchanger 3, mixes in the mixing chamber 22 with the non-cooled-off engine cooling medium flowing through the by-pass channel 19 so that by reason of the respective adjustment of the valves of the thermostat assembly 25 controlling the inlet openings 21 and 23, the predetermined operating temperature of the engine cooling medium is adjusted in the mixing chamber 22. An engine cooling medium which is always controlled within narrowest limits, is thus fed to the engine by way of the line pipe connection 31 after reaching the operating temperature.

For the exchange for purposes of control or replacement, both the heat-exchanger 3 as also the thermostat assembly 25 can be disassembled, examined and possibly be reassembled or replaced in a simple manner by removal of the cover 17 and the closure cover 27, respectively.

While I have shown and described only one embodiment in accordance with the present invention, it is understood that the same is not limited thereto but is susceptible of numerous changes and modifications as known to those skilled in the art, and I therefore do not wish to be limited to the details shown in and described herein but intend to cover all such changes and modifications as are encompassed by the scope of the appended claims.

I claim:

1. A cooling installation for a liquid-cooled internal combustion engine, comprising a housing means, a liquid heat-exchanger means positioned within said housing means for effecting heat exchange between an engine cooling liquid and an external cooling liquid such as fresh water or sea water, means for conveying an external cooling liquid to and from said heat-exchanger means in said housing means, by-pass channel means for the engine cooling liquid in parallel to the heat-exchanger means, said housing means including a mixing chamber means for the cooled and non-cooled portion of the engine cooling liquid, said mixing chamber means being arranged at a distance from the outlet side of the heat-exchanger means and having respective inlet openings leading into the mixing chamber means, one of the inlet openings being operatively connected with the heat-exchanger means and another inlet opening being operatively connected with the by-pass channel means, thermostat means for the temperature-dependent proportional through-flow control of the engine cooling liquid through the heat-exchanger means and the by-pass channel means, said thermostat means being arranged in the mixing chamber means and alternately controlling said respective inlet openings leading into the mixing chamber means, a closure cover means removably secured externally at the housing means being arranged opposite an inlet opening of the mixing chamber means and being operable to close an installation opening for the thermostat means, and wherein the by-pass channel means extends in a shaft-shaped narrow manner essentially over the entire length of the heat-exchanger means.

2. A cooling installation according to claim 1, wherein said closure cover means includes means which press the thermostat means sealingly against an inlet opening of the mixing chamber means.

3. A cooling installation according to claim 1, wherein said housing means includes a removable housing cover adjacent said heat-exchanger means to permit access to and removal of said heat-exchanger means from said housing means.

4. A cooling installation according to claim 1, characterized in that one inlet chamber means each is arranged in the longitudinal direction of the heat-exchanger means on both sides upstream of the inlet openings of the mixing chamber means, one of said inlet chamber means being operatively connected with the outlet side of the heat-exchanger means and the other inlet chamber means being operatively connected with the by-pass channel means.

5. A cooling installation according to claim 4, characterized in that a water box is provided on the outlet side of the heat-exchanger means, the one inlet chamber means being in communication with said water box.

6. A cooling installation according to claim 4, characterized in that the by-pass channel means passes over into the first inlet chamber means at a distance from the outlet side of the heat-exchanger means over a portion of the length of the heat-exchanger means whereas the mixing chamber means and the other inlet chamber means operatively connected with the outlet side of the heat-exchanger means extend also at a distance from the outlet side of the heat-exchanger means essentially over the remaining part of the length of the heat-exchanger means.

7. A cooling installation according to claim 6, characterized in that the second inlet chamber means includes an outside wall opposite the mixing chamber means which is constructed the removable closure cover means, said closure cover means having coaxial ring-shaped support extensions arranged at a distance to one another, which press the thermostat means sealingly against an inlet opening of the mixing chamber means, and being provided intermediate the support extensions with connecting openings from the outlet side of the heat-exchanger means into the inlet chamber means arranged inside of the support extensions.

8. A cooling installation according to claim 7, characterized in that said means for conveying an external cooling liquid to and from the heat-exchanger means includes at both longitudinal ends of the heat-exchanger means one hose-connecting means for the external cooling liquid which respectively extend through apertures in the housing means and in a removable housing cover coordinated thereto, the apertures each including a radial annular groove for an O-ring, whereby the heat-exchanger means can be removed from said housing means by removal of said housing cover.

9. A cooling installation according to claim 1, characterized in that said means for conveying an external cooling liquid to and from the heat-exchanger means includes at both longitudinal ends one hose-connecting means for the external cooling liquid which respectively extend through apertures in the housing means and in a removable cover coordinated thereto, the apertures each including a radial annular groove for an O-ring, whereby the heat-exchanger means can be removed from said housing means by removal of said housing cover.

* * * * *